US010343002B2

(12) United States Patent
Boraas

(10) Patent No.: US 10,343,002 B2
(45) Date of Patent: Jul. 9, 2019

(54) RESCUE STRAP ASSEMBLY

(71) Applicant: D B Industries, LLC, Red Wing, MN (US)

(72) Inventor: Michael A Boraas, St. Paul, MN (US)

(73) Assignee: D B Industries, LLC, Maplewood, MN (US)

( * ) Notice: Subject to any disclaimer, the term of this patent is extended or adjusted under 35 U.S.C. 154(b) by 0 days.

(21) Appl. No.: 15/161,602

(22) Filed: May 23, 2016

(65) Prior Publication Data

US 2017/0036046 A1 Feb. 9, 2017

Related U.S. Application Data

(60) Provisional application No. 62/200,847, filed on Aug. 4, 2015.

(51) Int. Cl.

| | |
|---|---|
| ***B66D 3/00*** | (2006.01) |
| ***A44B 11/25*** | (2006.01) |
| ***A62B 35/00*** | (2006.01) |

(52) U.S. Cl.

CPC ..... *A62B 35/0075* (2013.01); *B66D 3/00* (2013.01); *A44B 11/2557* (2013.01); *A44B 11/2569* (2013.01)

(58) Field of Classification Search

CPC ..... A44B 11/02; A44B 11/06; A44B 11/12; A44B 11/18; A44B 11/2503; A44B 11/2553; A44B 11/2557; A62B 35/00

See application file for complete search history.

(56) References Cited

U.S. PATENT DOCUMENTS

| | | | | | |
|---|---|---|---|---|---|
| 270,922 | A | * | 1/1883 | Aldrich | B65D 45/345 24/273 |
| 2,538,641 | A | * | 1/1951 | Elsner | A44B 11/06 24/133 |
| 2,679,670 | A | * | 6/1954 | Griswold | B60P 7/0838 24/273 |
| 3,178,788 | A | * | 4/1965 | Johns | A44B 19/06 24/411 |
| 3,999,254 | A | * | 12/1976 | McLennan | A44B 11/10 24/196 |

(Continued)

FOREIGN PATENT DOCUMENTS

| | | | | | |
|---|---|---|---|---|---|
| FR | 2556421 | A1 | * | 6/1985 | A44B 11/10 |
| GB | 191019319 | A | * | 10/1910 | A44B 11/02 |

(Continued)

OTHER PUBLICATIONS

M. Nehrdich, International Search Report, dated Oct. 31, 2016 (5 pages).

(Continued)

*Primary Examiner* — Tyrone V Hall, Jr.

(57) ABSTRACT

A rescue strap assembly comprising a connector, an adjuster, a mechanical advantage assembly, and a strap having a first end, an intermediate portion, and a second end. The first end is operatively connected to the connector and the mechanical advantage assembly, the intermediate portion is routed through the adjuster, and the mechanical advantage assembly is configured and arranged to engage at least a portion of the intermediate portion.

21 Claims, 9 Drawing Sheets

(56) References Cited

U.S. PATENT DOCUMENTS

| | | | | | |
|---|---|---|---|---|---|
| 4,315,350 | A * | 2/1982 | Looker | A44B 11/065 | 24/128 |
| 4,687,074 | A | 8/1987 | Green | | |
| 4,823,443 | A * | 4/1989 | Waters | A44B 11/125 | 24/68 CD |
| 5,426,827 | A * | 6/1995 | Tracy | A44B 11/065 | 24/68 CD |
| 5,809,620 | A * | 9/1998 | Crowley | B60P 7/0838 | 24/265 CD |
| 6,637,077 | B2 * | 10/2003 | Doty | B60P 3/079 | 24/298 |
| 8,267,050 | B1 * | 9/2012 | Hatcher | 119/795 | |
| 2009/0095232 | A1 * | 4/2009 | McKay | A62B 35/0006 | 119/770 |
| 2010/0242232 | A1 | 9/2010 | Wolner | | |

FOREIGN PATENT DOCUMENTS

| | | | | |
|---|---|---|---|---|
| GB | 223319 A * | 10/1924 | A44B 11/18 | |
| NL | 1022166 | 6/2004 | | |

OTHER PUBLICATIONS

RescueDirect.com, CMC ProSeries Pick Off Strap, <http://www.rescuedirect.com/Merchant2/merchant.mvc?Screen=PROD&Product_Code=201106&Category_Code=WEB>, printed Jul. 22, 2015, 2 pages.

petzl.com, JAG System, Technical Notice, P445000B (160714), known of prior to filing date, 18 pages.

* cited by examiner

ROTATE HANDLE DOWN

STEP 3

PULL DOWN HAND LOOP

STEP 4

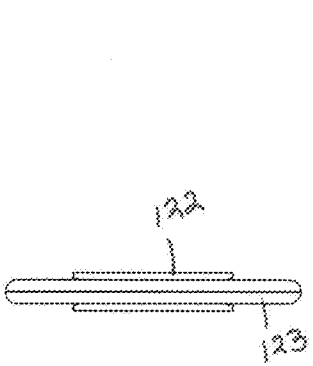
Fig. 8
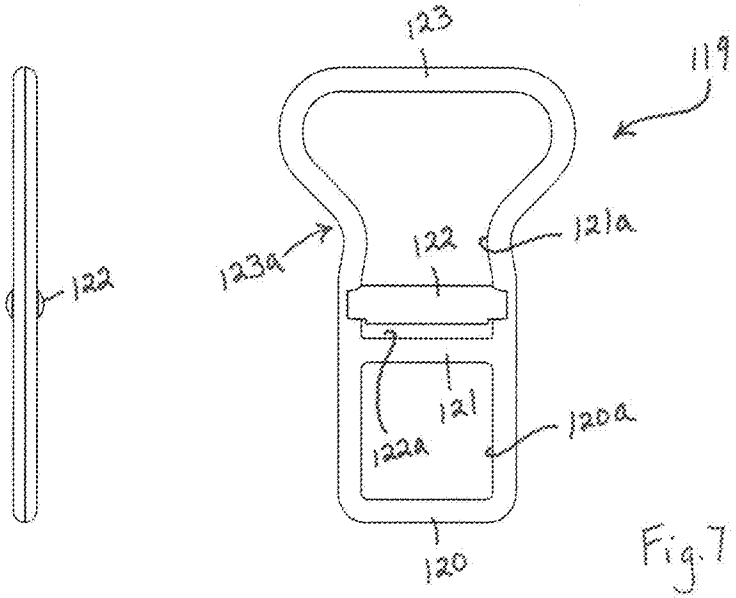
Fig. 7
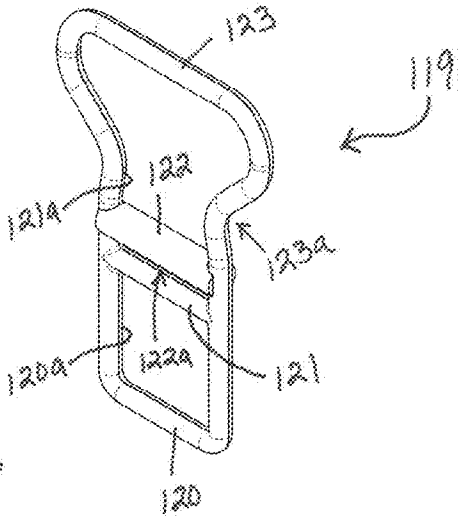
Fig. 6
Fig. 9

RESCUE STRAP ASSEMBLY

CROSS-REFERENCE TO RELATED APPLICATIONS

This application claims the benefit of U.S. Provisional Patent Application Ser. No. 62/200,847 filed Aug. 4, 2015, which is hereby incorporated by reference.

BACKGROUND

Rescue strap assemblies, commonly referred to as pick-off straps, are widely used in the rescue industry. A typical pick-off strap is a simple 2:1 mechanical advantage system. One end of the strap is connected to an anchor (e.g., the rescuer's lifeline) and the other end of the strap is connected to the person being rescued, the victim. Pulling up on the tail of the strap draws webbing through a progress capturing buckle and transfers the victim's weight onto the rescuer's primary line so that the victim can be unhooked from her/his lifeline and lowered.

In some situations, there is a need for either a secondary system, such as a block and tackle, or a haul team to assist in raising the victim until the victim's weight has transitioned to the rescuer's line.

For the reasons stated above and for other reasons stated below, which will become apparent to those skilled in the art upon reading and understanding the present specification, there is a need in the art for an improved rescue strap assembly.

BRIEF SUMMARY OF THE INVENTION

In one embodiment, a rescue strap assembly comprises a connector, an adjuster, a mechanical advantage assembly, and a strap having a first end, an intermediate portion, and a second end. The first end is operatively connected to the connector and the mechanical advantage assembly, the intermediate portion is routed through the adjuster, and the mechanical advantage assembly is configured and arranged to engage at least a portion of the intermediate portion.

In one embodiment, a rescue strap assembly comprises a connector, an adjuster, a lever member, and a strap. The connector has a first bar portion. The adjuster has a first engaging portion. The lever member has a second bar portion, a third bar portion, and a second engaging portion. The strap has a first end, an intermediate portion, and a second end. The first end is routed about a portion of the first bar portion and a portion of the second bar portion. The intermediate portion is routed about a portion of the first engaging portion, a portion of the third bar portion, and a portion of the second engaging portion.

In one embodiment, a rescue strap assembly comprises a connector, an adjuster, a ratchet device, and a strap. The connector has a first bar portion. The adjuster has a first engaging portion. The ratchet device has a second bar portion and a second engaging portion. The strap has a first end, an intermediate portion, and a second end. The first end is routed about a portion of the first bar portion and a portion of the second bar portion. The intermediate portion is routed about a portion of the first engaging portion and about a portion of the second engaging portion.

BRIEF DESCRIPTION OF THE DRAWINGS

FIG. 6 is a perspective view of a lever of the rescue strap assembly shown in FIG. 1.

FIG. 7 is a front view of the lever shown in FIG. 6.

FIG. 8 is a top view of the lever shown in FIG. 6.

FIG. 9 is a side view of the lever shown in FIG. 6.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Generally, the invention is an improved rescue strap assembly that incorporates a mechanical advantage device. It is recognized that many suitable types of mechanical advantage devices or assemblies could be used such as, but not limited to, levers, ratchet devices, and pulleys.

In one embodiment, the mechanical advantage device includes a lever member with a tensioner to provide additional mechanical advantage during use.

Figure 1:
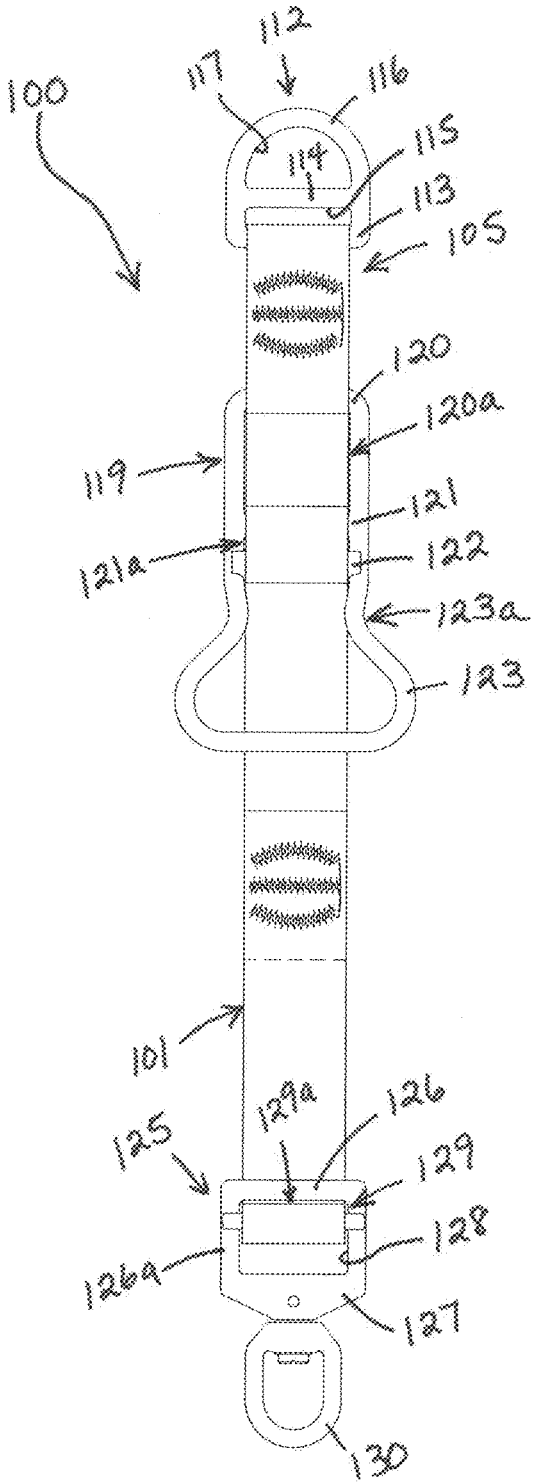
FIG. 1 is a front view of a rescue strap assembly constructed in accordance with the principles of the present invention.
Figure 2:
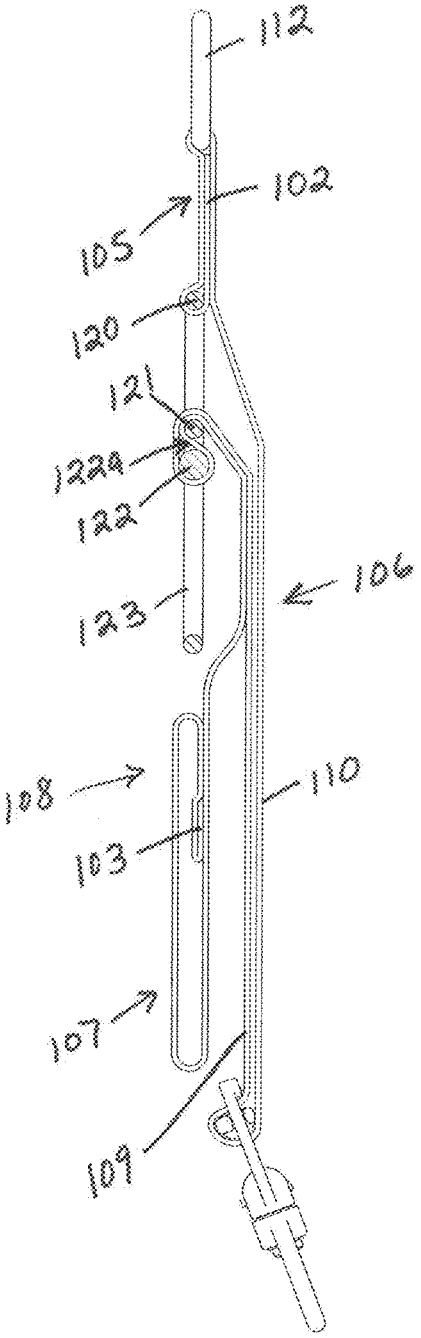
FIG. 2 is a partially cross-sectional side view of the rescue strap assembly shown in FIG. 1 in a first position.

In this embodiment, referring to FIGS. 1-2, the rescue strap assembly 100 includes a strap 101, a connector 112, a lever member 119, and an adjuster 125.

The strap 101 has a first distal end 102 and a second distal end 103. The strap 101 is preferably made of webbing, but any suitable material could be used.

The connector 112 is generally a D-ring shaped connector including a first bar portion 113, a second bar portion 114, and a ring portion 116. The first bar portion 113 and the second bar portion 114 are interconnected with sides and form a first opening 115. The ring portion 116 extends outward from the second bar portion 114 and forms a second opening 117. It is recognized that any suitable connector could be used.

The lever member 119 includes a first bar portion 120, a second bar portion 121, an engaging portion 122, and a handle portion 123. The lever member 119 is further shown in FIGS. 6-9. The first bar portion 120 and the second bar portion 121 are interconnected with sides and form a first opening 120*a*. The handle portion 123 extends longitudinally outward proximate the second bar portion 121 and then includes an area of reduced width 123*a* before it flares laterally outward in width to provide a more accessible handle member. The second bar portion 121 and the handle portion 123 form a second opening 121*a*. The engaging portion 122 is preferably a sliding friction bar that is slidable within the second opening 121*a* between the second bar portion 121 and the area of reduced width 123*a*. The sliding friction bar portion includes generally U-shaped ends configured and arranged to receive portions of the handle portion 123 thereby allowing it to slidably engage the handle portion 123. The second bar portion 121 and the sliding friction bar portion form a slot 122*a* within the second opening 121*a*.

The adjuster 125 is generally rectangular and includes a first end 126, a second end 127, and an engaging portion 129. The first end 126 and the second end 127 are interconnected with sides 126*a* and form an opening 128. The engaging portion 129 is preferably a sliding friction bar portion that includes generally U-shaped ends configured and arranged to receive portions of the sides 126*a* thereby allowing it to slidably engage the sides 126*a* and slide within the opening 128 between the first end 126 and the second end 127. A slot 129*a* is formed within the opening 128 between the first end 126 and the sliding friction bar portion. A connector 130 is operatively connected to the second end 127.

To assemble the rescue strap assembly 100 in the orientation shown in FIG. 2, the first distal end 102 of the strap 101 is routed through the first opening 115 in the connector, downward through the first opening 120*a* of the lever member 119, and then upward between two layers of the strap 101. The second distal end 103 of the strap 101 is routed through opening 128 of the adjuster 125, upward over the engaging portion 129, and upward through the slot 129*a*. The second distal end 103 is then routed through the first opening 120*a*, downward through the second opening 121*a*, upward through the slot 122*a*, upward through the first opening 120*a* between the second bar portion 121 and the strap 101, and then it extends downward to form a looped portion 107. The portion proximate the connector 112 is a first end 105, the portion proximate the adjuster 125 is a second end 108, and the portion therebetween is an intermediate portion 106. It is recognized that the rescue strap assembly 100 could be assembled using other suitable assembly techniques.

The first end 105 of the strap 101 interconnects the lever member 119 and the connector 112, which is connected to an anchor or an anchor line. The intermediate portion 106 of the strap 101 extends downward from proximate the connector 112 and is routed through the adjuster 125, which is preferably a progress capturing buckle and is connected to the victim, and then extends upward and is routed through the lever member 119. The second distal end 103 of the strap 101 forms the looped portion 107, which the user can use to take out slack in the non-load bearing portion 109 of the intermediate portion 106 of the strap 101.

Figure 3:
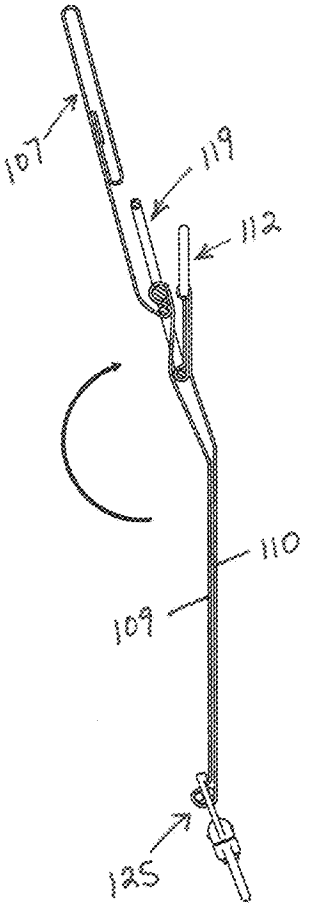
FIG. 3 is a partially cross-sectional side view of the rescue strap assembly shown in FIG. 1 in a second position.
Figure 4:
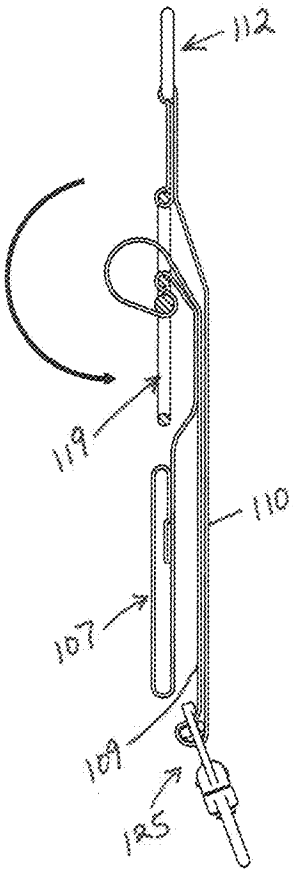
FIG. 4 is a partially cross-sectional side view of the rescue strap assembly shown in FIG. 1 in a third position.
Figure 5:
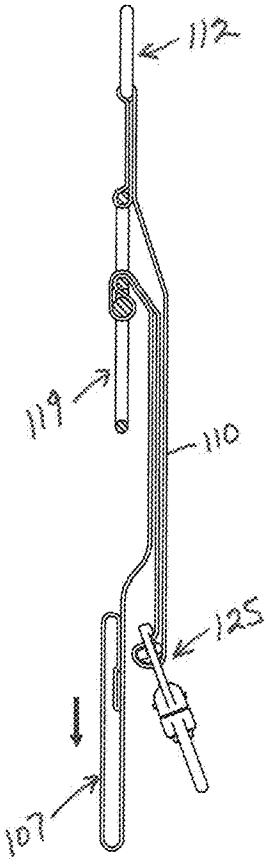
FIG. 5 is a partially cross-sectional side view of the rescue strap assembly shown in FIG. 1 in a fourth position.

In operation, the lever member 119 starts in a downward position as shown in the orientation shown in FIG. 2. Tension is pulled out of the strap 101 by pulling on the looped portion 107. The first bar portion 120 of the lever member 119 is pivotally attached to the strap 101 via the loop formed in the strap 101 proximate the first distal end 102 of the strap 101. Then, as the lever member 119 is pivoted upward about its first bar portion 120, as shown in FIG. 3, it draws the strap 101 through the adjuster 125 proximate the bottom of the assembly. The second bar portion 121 and the engaging portion 122 engage the strap 101 as tension is applied. The lever member 119 is then pivoted back downward about its first bar portion 120 thereby creating slack in the non-load bearing portion 109 of the strap 101, as shown in FIG. 4, and the slack is taken out of the non-load bearing portion 109 of the strap 101 by pulling downward on the looped portion 107, as shown in FIG. 5. The process is repeated until the victim has been raised sufficiently. The lever member 119 provides a mechanical advantage and is generally not load bearing. Therefore, the lever member 119 does not have to be robust to carry any significant load.

By integrating a mechanical advantage device into the rescue strap assembly, a compact, cost-effective rescue strap assembly allows a rescuer to more easily raise a victim and get sufficient weight off the victim's lifeline to remove the lifeline from the victim. This embodiment provides a theoretical 6:1 mechanical advantage system (2:1 via the bottom buckle times 3:1 via the lever), and this eliminates the need for either a secondary system (such as a block and tackle) or a haul team to raise the victim until the victim's weight has transitioned to the rescuer's line. It also gives better control over how much and how fast the victim is raised to the rescuer who is in closest proximity to the victim.

Figure 10:
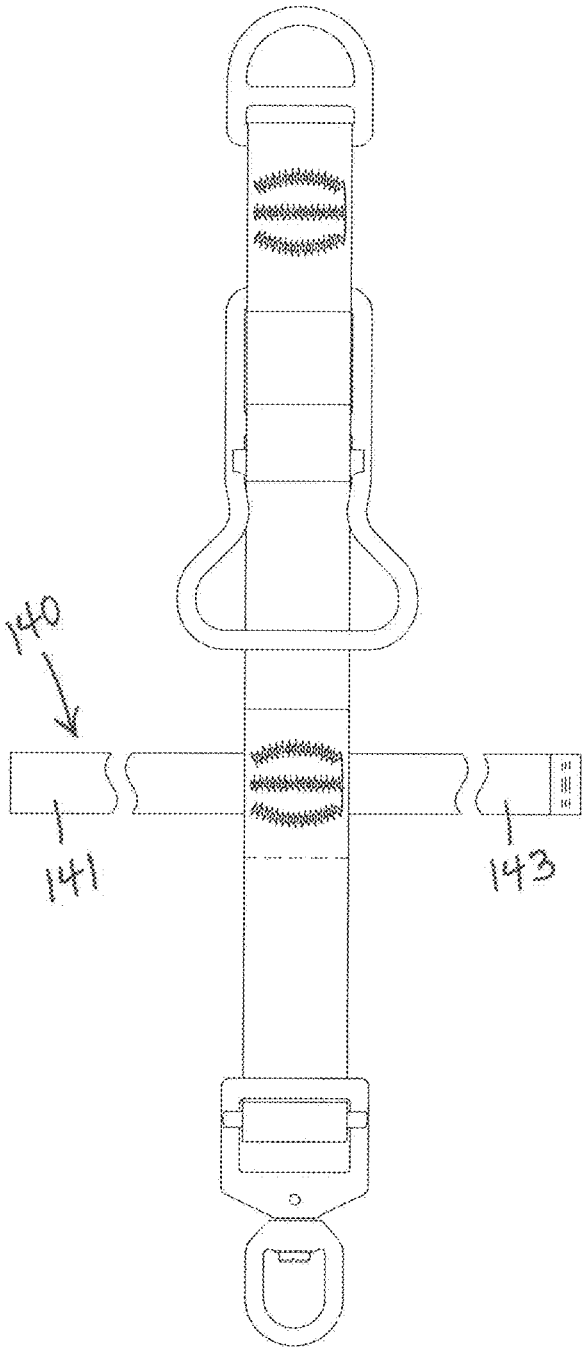
FIG. 10 is a front view of another embodiment of a rescue strap assembly constructed in accordance with the principles of the present invention.
Figure 11:
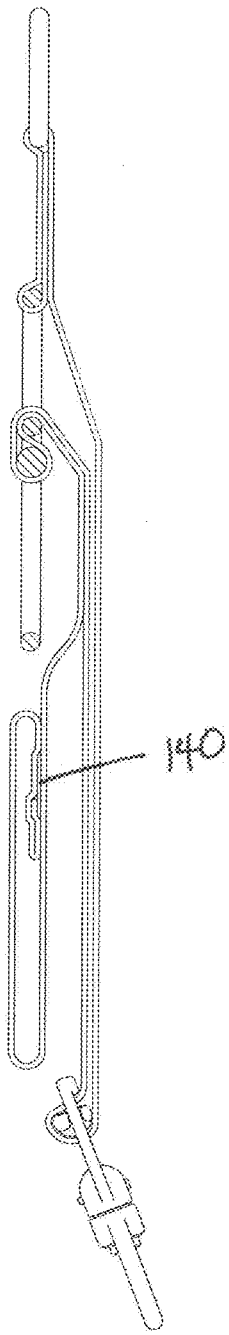
FIG. 11 is a partially cross-sectional side view of the rescue strap assembly shown in FIG. 10 in a first position.

Optionally, another embodiment is shown in FIGS. 10 and 11. The rescue strap assembly could also include a securing member 140 connected between overlapping portions of the second distal end. The securing member 140 includes a first arm 141 and a second arm 143 extending outward laterally proximate the second distal end. The first arm 141 and the second arm 143 include mating fasteners such as but not limited to hook and loop fastener. The securing member 140 allows the rescue strap assembly to be folded into a more compact storage arrangement and releasably secured in this arrangement by wrapping the first and second arms about the arrangement and then connecting the mating fasteners.

Figure 12:
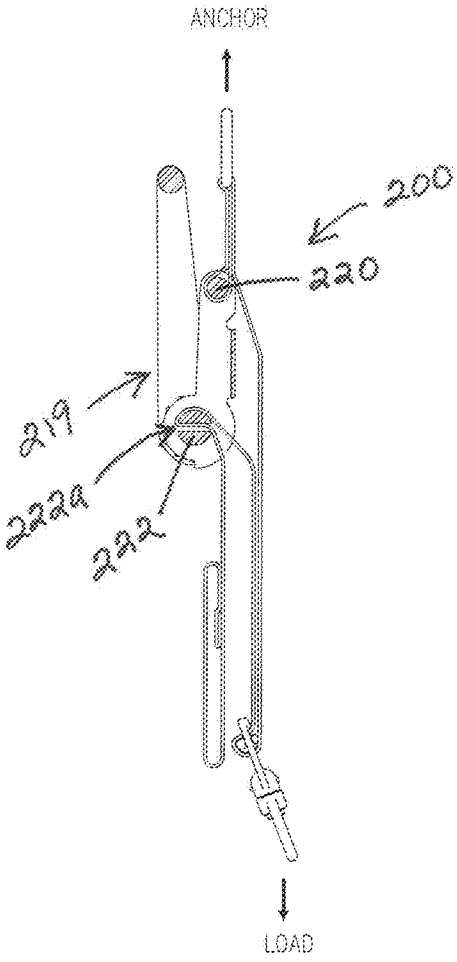
FIG. 12 is a partially cross-sectional side view of another embodiment of a rescue strap assembly constructed in accordance with the principles of the present invention.

In another embodiment, referring to FIG. 12, the mechanical advantage device includes a ratchet device to provide additional mechanical advantage during use.

In this embodiment, the rescue strap assembly 200 includes the ratchet device 219. Because the rescue strap assembly 200 is similar to the rescue strap assembly 100, only the significant differences are being described. Similar to the rescue strap assembly 100, the non-load bearing portion of the strap is routed through the ratchet device 219. The first end of the strap interconnects the connector and a first bar portion 220 of the ratchet device 219. The intermediate portion of the strap is routed through an adjuster and through a slot 222*a* of a second bar portion 222 of the ratchet device 219. As the handle of the ratchet device 219 is rotated, the second bar portion 222 rotates to wind any slack in the intermediate portion about the second bar portion 222.

Figure 13:
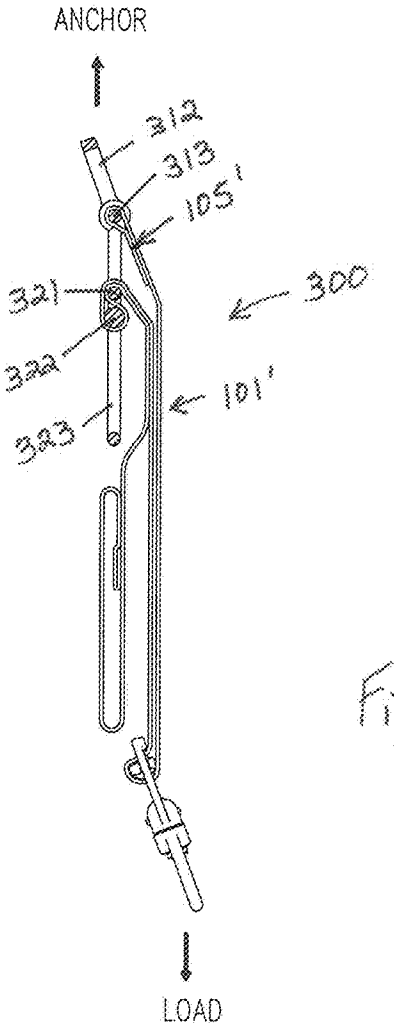
FIG. 13 is a partially cross-sectional side view of another embodiment of a rescue strap assembly constructed in accordance with the principles of the present invention.
Figure 14:
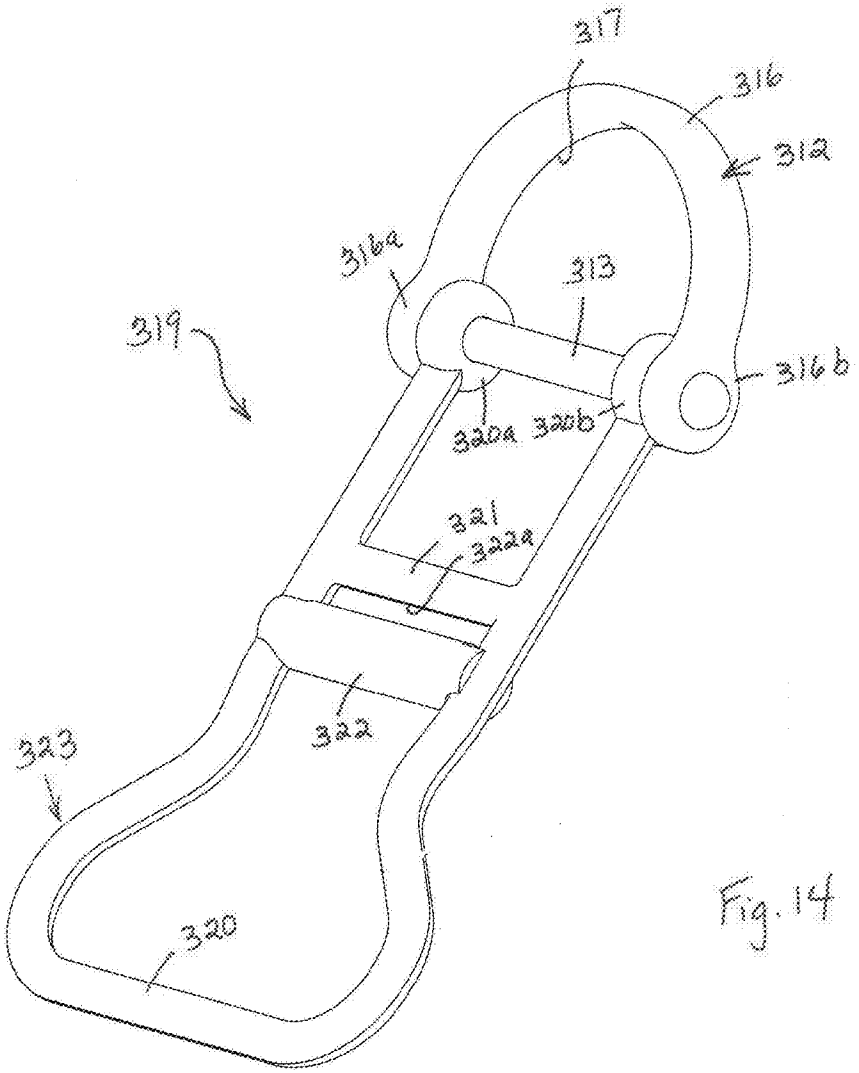
FIG. 14 is a perspective view of a lever of the rescue strap assembly shown in FIG. 13.

In another embodiment, referring to FIGS. 13 and 14, the mechanical advantage device includes another embodiment lever member to provide additional mechanical advantage during use.

In this embodiment, the rescue strap assembly 300 includes a lever member 319. Because the rescue strap assembly 300 is similar to the rescue strap assembly 100, only the significant differences are being described. Similar to the rescue strap assembly 100, the non-load bearing portion of the strap 101' is routed through the lever member 319. A connector 312 is operatively connected to the lever member 319 with a bar member 313 to which the first end 105' of the strap 101' is connected. Therefore, the first end 105' is operatively connected to the connector 312 and the lever member 319 via the bar member 313. The connector 312 includes a ring portion 316 and an opening 317. Opposing ends 316*a* and 316*b* of the ring portion 316, which is generally U-shaped, include apertures and opposing ends 320*a* and 320*b* of the lever member 319 include apertures. The apertures of the ring portion 316 and the lever member 319 align to form a channel through which the bar member 313 extends to pivotally interconnect the ring portion 316 and the lever member 319. The intermediate portion of the strap is routed through an adjuster and through a slot 322*a* formed between a bar portion 321 and a sliding friction bar portion 322. The lever member 319 pivots about the bar member 313 but otherwise operates similarly to the lever member 119.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A rescue strap assembly, comprising:
a connector;
an adjuster;
a mechanical advantage assembly; and
a strap having a first end, an intermediate portion, and a second end, wherein the first end is operatively connected to the connector and the mechanical advantage assembly to define a fixed distance between a proximal portion of the connector and a distal portion of the mechanical advantage assembly, wherein the intermediate portion is routed through the adjuster, and wherein the mechanical advantage assembly is configured and arranged to engage at least a portion of the intermediate portion;
wherein the distal portion of the mechanical advantage assembly is positioned between the adjuster and the proximal portion of the connector.

2. The rescue strap assembly of claim 1, wherein the adjuster is a progress capturing buckle.

3. The rescue strap assembly of claim 1, wherein the mechanical advantage assembly is an assembly selected from the group consisting of a lever member and a ratchet device.

4. The rescue strap assembly of claim 1, wherein the first end of the strap is operatively connected to the connector and the mechanical advantage assembly via a bar member, the mechanical advantage assembly being pivotable about the bar member.

5. The rescue strap assembly of claim 1, wherein the second end forms a looped portion.

6. The rescue strap assembly of claim 5, further comprising a securing member operatively connected to the looped portion, the securing member configured and arranged to releasably secure the strap in a compact storage arrangement.

7. The rescue strap assembly of claim 5, wherein the looped portion extends outward from proximate the mechanical advantage assembly.

8. The rescue strap assembly of claim 5, wherein the looped portion engages the mechanical advantage assembly.

9. A rescue strap assembly, comprising:
a connector having a first bar portion;
an adjuster having a first engaging portion;
a lever member having a second bar portion, a third bar portion, and a second engaging portion; and
a strap having a first end, an intermediate portion, and a second end, wherein the first end is routed about a portion of the first bar portion and a portion of the second bar portion to define a fixed distance between the first bar portion and the second bar portion, and wherein the intermediate portion is routed about a portion of the first engaging portion, a portion of the third bar portion, and a portion of the second engaging portion;
wherein the lever member is positioned between the connector and the adjuster.

10. The rescue strap assembly of claim 9, wherein the adjuster is a progress capturing buckle and the first engaging portion includes a sliding bar portion.

11. The rescue strap assembly of claim 9, wherein the second engaging portion includes a sliding bar portion.

12. The rescue strap assembly of claim 9, wherein the intermediate portion is routed about the portion of the third bar portion and overlaps itself about the portion of the second engaging portion.

13. The rescue strap assembly of claim 9, wherein the lever member is pivotal about the second bar portion relative to the first end.

14. The rescue strap assembly of claim 9, wherein the first bar portion and the second bar portion are integral and form a bar member pivotally interconnecting the connector and the lever member.

15. The rescue strap assembly of claim 9, wherein the second end forms a looped portion.

16. The rescue strap assembly of claim 15, further comprising a securing member operatively connected to the looped portion, the securing member configured and arranged to releasably secure the strap in a compact storage arrangement.

17. A rescue strap assembly, comprising:
a connector having a first bar portion;
an adjuster having a first engaging portion;
a ratchet device having a second bar portion and a second engaging portion; and
a strap having a first end, an intermediate portion, and a second end, the first end being routed about a portion of the first bar portion and a portion of the second bar portion, the intermediate portion being routed about a portion of the first engaging portion and about a portion of the second engaging portion;
wherein the ratchet device is positioned between the connector and the adjuster.

18. The rescue strap assembly of claim 17, wherein the second end forms a looped portion.

19. The rescue strap assembly of claim 18, wherein the looped portion extends outward from proximate the ratchet device.

20. The rescue strap assembly of claim 17, wherein the second engaging portion includes a slot through which the strap is routed.

21. The rescue strap assembly of claim 20, wherein the second end forms a looped portion and the looped portion extends through the slot.

* * * * *